US008203260B2

(12) United States Patent
Li et al.

(10) Patent No.: US 8,203,260 B2
(45) Date of Patent: Jun. 19, 2012

(54) COLOR TEMPERATURE TUNABLE WHITE LIGHT SOURCE

(75) Inventors: Yi-Qun Li, Danville, CA (US); Yi Dong, Tracy, CA (US); Xiaofeng Xu, Fremont, CA (US)

(73) Assignee: Intematix Corporation, Fremont, CA (US)

( * ) Notice: Subject to any disclaimer, the term of this patent is extended or adjusted under 35 U.S.C. 154(b) by 683 days.

(21) Appl. No.: 11/787,107

(22) Filed: Apr. 13, 2007

(65) Prior Publication Data

US 2008/0252197 A1 Oct. 16, 2008

(51) Int. Cl.
*H01J 1/62* (2006.01)

(52) U.S. Cl. ..... 313/502; 345/83; 345/82; 315/112; 315/113; 315/156; 315/169.1; 315/291; 315/294; 315/312; 315/360

(58) Field of Classification Search ..... 345/82–83; 257/88–98; 315/112–113, 156, 169.1, 291, 315/294, 312, 360
See application file for complete search history.

(56) References Cited

U.S. PATENT DOCUMENTS

| | | | | |
|---|---|---|---|---|
| 6,271,825 | B1 | 8/2001 | Greene et al. | |
| 6,504,179 | B1 * | 1/2003 | Ellens et al. | 257/88 |
| 6,692,136 | B2 * | 2/2004 | Marshall et al. | 362/231 |
| 6,760,515 | B1 * | 7/2004 | Wang et al. | 385/31 |
| 7,014,336 | B1 | 3/2006 | Ducharme et al. | |
| 7,038,641 | B2 * | 5/2006 | Hirota et al. | 345/83 |
| 7,042,162 | B2 * | 5/2006 | Yamazaki et al. | 315/169.1 |
| 2002/0105487 | A1 * | 8/2002 | Inoue | 345/82 |
| 2004/0203312 | A1 | 10/2004 | Bortscheller et al. | |
| 2005/0123243 | A1 | 6/2005 | Steckl et al. | |
| 2005/0152146 | A1 | 7/2005 | Owen et al. | |
| 2005/0270775 | A1 | 12/2005 | Harbers et al. | |
| 2005/0276053 | A1 | 12/2005 | Nortrup et al. | |
| 2006/0109219 | A1 * | 5/2006 | Robinson et al. | 345/83 |
| 2006/0114201 | A1 * | 6/2006 | Chang | 345/83 |
| 2006/0177098 | A1 | 8/2006 | Stam | |
| 2006/0198128 | A1 | 9/2006 | Piepgras et al. | |
| 2006/0239006 | A1 | 10/2006 | Chaves et al. | |
| 2006/0279490 | A1 * | 12/2006 | Park et al. | 345/76 |
| 2007/0031097 | A1 | 2/2007 | Heikenfeld et al. | |
| 2007/0080364 | A1 | 4/2007 | Hsiung | |
| 2007/0086184 | A1 | 4/2007 | Pugh et al. | |
| 2008/0109219 | A1 * | 5/2008 | Lin | 704/212 |
| 2008/0204383 | A1 * | 8/2008 | McCarthy et al. | 345/83 |

OTHER PUBLICATIONS

International Search Report and Written Opinion dated Jul. 2, 2008 for International Application No. PCT/US08/04567, 7 pages.
European Patent Office, Extended European Search Report for European Patent Application No. EP 08742671.4, May 25, 2011, 8 pages.

* cited by examiner

*Primary Examiner* — Alexander S Beck
*Assistant Examiner* — Jeffrey Steinberg
(74) *Attorney, Agent, or Firm* — Fliesler Meyer LLP

(57) ABSTRACT

A color temperature tunable white light source comprises: first and second LED arrangements operable to emit light of first and second wavelength range respectively that are configured such that their combined light output, which comprises light generated by the source, appears white in color. One or both LED arrangements comprises a phosphor provided remote to an associated LED operable to generate excitation radiation and to irradiate the phosphor such that it emits light of a different wavelength range, wherein the light emitted by the LED arrangement comprises the combined light from the LED and phosphor. The color temperature of output white light is tunable by controlling the relative light outputs of the LED arrangements by for example controlling the relative magnitude of the drive currents of the LEDs or a duty cycle of a pulse width modulated drive current.

11 Claims, 8 Drawing Sheets

COLOR TEMPERATURE TUNABLE WHITE LIGHT SOURCE

BACKGROUND OF THE INVENTION

1. Field of the Invention

This invention relates to a color temperature tunable white light source and in particular to a light source based on light emitting diode arrangements. Moreover the invention provides a method of generating white light of a selected color temperature.

2. Description of the Related Art

As is known the correlated color temperature (CCT) of a white light source is determined by comparing its hue with a theoretical, heated black-body radiator. CCT is specified in Kelvin (K) and corresponds to the temperature of the black-body radiator which radiates the same hue of white light as the light source. Today, the color temperature from a white light source is determined predominantly by the mechanism used to generate the light. For example incandescent light sources always give a relatively low color temperature around 3000K, called "warm white". Conversely, fluorescent lights always give a higher color temperature around 7000K, called "cold white". The choice of warm or cold white is determined when purchasing the light source or when a building design or construction is completed. In many situations, such as street lighting, warm white and cold white light is used together.

White light emitting diodes (LEDs) are known in the art and are a relatively recent innovation. It was not until LEDs emitting in the blue/ultraviolet part of the electromagnetic spectrum were developed that it became practical to develop white light sources based on LEDs. As is known white light generating LEDs ("white LEDs") include one phosphor materials, that is a photo luminescent materials, which absorbs a portion of the radiation emitted by the LED and re-emits radiation of a different color (wavelength). Typically, the LED die or chip generates blue light in the visible part of the spectrum and the phosphor re-emits yellow or a combination of green and red light, green and yellow or yellow and red light. The portion of the visible blue light generated by the LED which is not absorbed by the phosphor mixes with the yellow light emitted to provide light which appears to the eye as being white in color. The CCT of a white LED is determined by the phosphor composition incorporated in the LED.

It is predicted that white LEDs could potentially replace incandescent, fluorescent and neon light sources due to their long operating lifetimes, potentially many 100,000 of hours, and their high efficiency in terms of low power consumption. Recently high brightness white LEDs have been used to replace conventional white fluorescent, mercury vapor lamps and neon lights. Like other lighting sources the CCT of a white LED is fixed and is determined by the phosphor composition used to fabricate the LED.

U.S. Pat. No. 7,014,336 discloses systems and methods of generating high-quality white light, that is white light having a substantially continuous spectrum within the photopic response (spectral transfer function) of the human eye. Since the eye's photopic response gives a measure of the limits of what the eye can see this sets boundaries on high-quality white light having a wavelength range 400 nm (ultraviolet) to 700 nm (infrared). One system for creating white light comprises three hundred LEDs each of which has a narrow spectral width and a maximum spectral peak spanning a predetermined portion of the 400 to 700 nm wavelength range. By selectively controlling the intensity of each of the LEDs the color temperature (and also color) can be controlled. A further lighting fixture comprises nine LEDs having a spectral width of 25 nm spaced every 25 nm over the wavelength range. The powers of the LEDs can be adjusted to generate a range of color temperatures (and colors as well) by adjusting the relative intensities of the nine LEDs. It is also proposed to use fewer LEDs to generate white light provided each LED has an increased spectral width to maintain a substantially continuous spectrum that fills the photopic response of the eye. Another lighting fixture comprises using one or more white LEDs and providing an optical high-pass filter to change the color temperature of the white light. By providing a series of interchangeable filters this enables a single light fixture to produce white light of any temperature by specifying a series of ranges for the various filters.

The present invention arose in an endeavor to provide a white light source whose color temperature is at least in part tunable.

SUMMARY OF THE INVENTION

According to the invention a color temperature tunable white light source comprises: a first light emitting diode LED arrangement operable to emit light of a first wavelength range and a second light emitting diode LED arrangement operable to emit light of a second wavelength range, the LED arrangements being configured such that their combined light output, which comprises the output of the source, appears white in color; characterized in that the first LED arrangement comprises a phosphor provided remote to an associated first LED operable to generate excitation energy of a selected wavelength range and to irradiate the phosphor such that it emits light of a different wavelength range, wherein the light emitted by the first LED arrangement comprises the combined light from the first LED and the light emitted from the phosphor and control means operable to control the color temperature by controlling the relative light outputs of the two LED arrangements. In the context of this patent application "remote" means that the phosphor is not incorporated within the LED during fabrication of the LED.

In one arrangement the second LED arrangement also comprises a respective phosphor which is provided remote to an associated second LED operable to generate excitation energy of a selected wavelength range and to irradiate the phosphor such that it emits light of a different wavelength range, wherein the light emitted by the second LED arrangement comprises the combined light from the second LED and the light emitted from the phosphor and wherein the control means is operable to control the color temperature by controlling relative irradiation of the phosphors.

The color temperature can be tuned by controlling the relative magnitude of the drive currents of the respective LEDs using for example a potential divider arrangement. Alternatively, the drive currents can be dynamically switched and the color temperature tuned by controlling a duty cycle of the drive current to control the relative proportion of time each LED emits light. In such an arrangement the control means can comprise a pulse width modulated (PWM) power supply which is operable to generate a PWM drive current whose duty cycle is used to select a desired color temperature. Preferably, the light emitting diodes are driven on opposite phases of the PWM drive current. A particular advantage of the invention resides in the use of only two LED arrangements since this enables the color temperature to be tuned by controlling two relative drive currents which can be readily implemented using simple and inexpensive drive circuitry.

In one arrangement the first and second LED arrangements emit different colors of light which when combined these appear white in color. An advantage of such an arrangement to generate white light is an improved performance, in particular lower absorption, as compared to an arrangement in which the LED arrangements each generate white light of differing color temperatures. In one such arrangement the phosphor emits green or yellow light and the second LED arrangement emits red light. Preferably, the first LED used to excite the phosphor is operable to emit light in a wavelength range 440 to 470 nm, that is blue light.

In a further arrangement light emitted by the first LED arrangement comprises warm white (WW) light with a color temperature in a range 2500K to 4000K and light emitted by the second LED arrangement comprises cold white (CW) light with a color temperature in a range 6000K to 10,000K. Preferably, the WW light has chromaticity coordinates CIE (x, y) of (0.44, 0.44) and the CW light has chromaticity coordinates CIE (x, y) of (0.3, 0.3).

In another arrangement the first phosphor emits green light with chromaticity coordinates CIE (x, y) of (0.22, 0.275) and the second phosphor emits orange light with chromaticity coordinates CIE (x, y) of (0.54, 0.46). Preferably, the LED used to excite the phosphors is operable to emit light in a wavelength range 440 to 470 nm.

In a further arrangement the phosphors share a common excitation source such that the second LED arrangement comprises a respective phosphor provided remote to the first LED and wherein the first LED is operable to generate excitation energy for the two phosphors and the source further comprises a respective light controller associated with each phosphor and the control means is operable to select the color temperature by controlling the light controller to control relative irradiation of the phosphors. Preferably, the light controller comprises a liquid crystal shutter for controlling the intensity of excitation energy reaching the associated phosphor. With an LCD shutter the control means is advantageously operable to select the color temperature by controlling the relative drive voltages of the respective LCD shutter. Alternatively, the control means is operable to dynamically switch the drive voltage of the LCD shutters and the color temperature is tunable by controlling a duty cycle of the voltage. Preferably the control means comprises a pulse width modulated power supply operable to generate a pulse width modulated drive voltage.

To increase the intensity of the light output, the source comprises a plurality of first and second LED arrangements that are advantageously configured in the form of an array, for example a square array, to improve color uniformity of the output light.

Since the color temperature is tunable the light source of the invention finds particular application in street lighting, vehicle headlights/fog lights or applications in which the source operates in an environment in which visibility is impaired by for example moisture, fog, dust or smoke. Advantageously, the source further comprises a sensor for detecting for the presence of moisture in the atmospheric environment in which the light source is operable and the control means is further operable to control the color temperature in response to the sensor.

According to the invention a method of generating white light with a tunable color temperature comprises: providing a first light emitting diode LED arrangement and operating it to emit light of a first wavelength range and providing a second light emitting diode LED arrangement and operating it to emit light of a second wavelength range, the LED arrangements being configured such that their combined light output appears white in color; characterized by the first LED arrangement comprising a phosphor provided remote to an associated first LED operable to generate excitation energy of a selected wavelength range and to irradiate the phosphor such that it emits light of a different wavelength range, wherein the light emitted by the first LED arrangement comprises the combined light from the first LED and the light emitted from the phosphor and controlling the color temperature by controlling the relative light outputs of the two LED arrangements.

As with the light source in accordance with the invention the second LED arrangement can comprise a respective phosphor provided remote to an associated second LED operable to generate excitation energy of a selected wavelength range and to irradiate the phosphor such that it emits light of a different wavelength range, wherein the light emitted by the second LED arrangement comprises the combined light from the second LED and the light emitted from the phosphor and controlling the color temperature by controlling the relative irradiation of the phosphors.

The method further comprises controlling the color temperature by controlling the relative magnitude of the drive currents of the respective LEDs. Alternatively, the drive currents of the respective LEDs can be dynamically switched and a duty cycle of the drive current controlled to control the color temperature. Advantageously the method further comprises generating a pulse width modulated drive current and operating the respective LEDs on opposite phases of the drive current.

Where the second LED arrangement comprises a respective phosphor provided remote to the first LED and wherein the first LED is operable to generate excitation energy for the two phosphors the method further comprises providing a respective light controller associated with each phosphor and controlling the color temperature by controlling the light controller to control relative irradiation of the phosphors. The color temperature can be controlled by controlling the relative drive voltages of the respective light controllers. Alternatively the drive voltage of the light controllers can be switched dynamically and the color temperature controlled by controlling a duty cycle of the voltage.

According to the invention a color temperature tunable white light source comprises: a first light emitting diode arrangement operable to emit light of a first wavelength range and a second light emitting diode arrangement operable to emit light of a second wavelength range, the light emitting diode arrangements being configured such that their combined light output, which comprises the output of the source, appears white in color; characterized by a sensor for detecting for the presence of moisture in the atmospheric environment in which the light source is operable and control means operable to control the relative light outputs of the two light emitting diode arrangements in response to the sensor to set a selected color temperature of emitted white light.

According to a further aspect of the invention a color temperature tunable white light source comprises: first and second light emitting diode arrangements which comprise a respective phosphor and at least one light emitting diode operable to generate excitation energy of a selected wavelength range and to irradiate the phosphors such that each emits light of a different wavelength range, wherein the light emitted by each light emitting diode arrangement respectively comprises the combined light from the light emitting diode and the light emitted from the phosphor, the light emitting diode arrangements being configured such that their combined light output, which comprises the output of the source, appears white in color; characterized by a controllable light controller associated with each phosphor and operable to control relative irradiation of the phosphors and control means operable to select the color temperature by controlling the light controller.

BRIEF DESCRIPTION OF THE DRAWINGS

In order that the present invention is better understood embodiments of the invention will now be described, by way of example only, with reference to the accompanying drawings in which.

DETAILED DESCRIPTION OF THE INVENTION

Figure 1A:
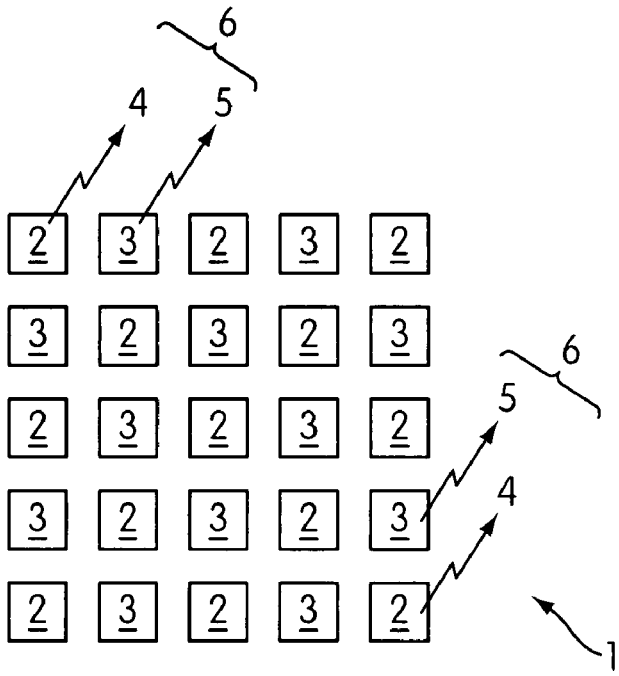
FIGS. 1*a* and 1*b* schematic representations of a color temperature tunable white light source in accordance with the invention.

Referring to FIG. 1*a* there is shown a schematic representation of a color temperature tunable (selectable) white light source 1 in accordance with the invention that comprises an array of first light emitting diode (LED) arrangements 2 and second LED arrangements 3. In the example the array comprises a regular square array of twenty five LED arrangements with thirteen first and twelve second LED arrangements. It will be appreciated that the invention is not limited to a particular number of LED arrangements or a particular geometric layout. Each of the first LED arrangements 2 is operable to emit warm white (WW) light 4 and each of the second LED arrangements 3 is operable to emit cold white (CW) light 5. In this patent application WW light is white light with a color temperature in a range 2500K to 4000K and CW light is white light with a color temperature in a range 6000K to 10000K. The combined light 4 and 5 emitted by the LED arrangements 2, 3 comprises the light output 6 of the source 1 and will appear white in color. As is described the color temperature of the output light 6 depends on the relative proportion of CW and WW light contributions. Each of the LED arrangements 2, 3 comprises a region of phosphor material 7, 8 which is provided remote to an associated LED 9, 10. The LEDs 9, are operable to generate excitation energy 11, 12 of a selected wavelength range and to irradiate the phosphor such that it emits light 13, 14 of a different wavelength range and the arrangement configured such that light 4, 5 emitted by the LED arrangement comprises the combined light 11, 12 from the LED and the light 13, 14 emitted from the phosphor. Typically the LEDs 9, 10 comprises a blue/UV LED and the phosphor region 7, 8 a mixture of colored phosphors such that its light output appears white in color.

Figure 1B:
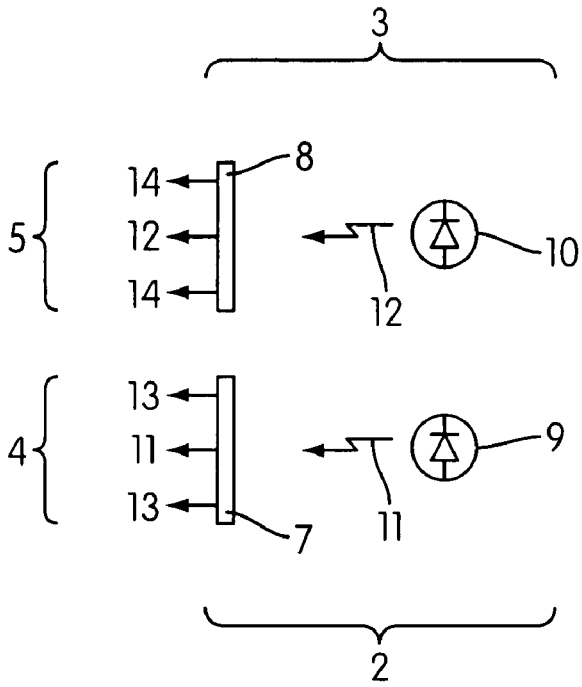
Figure 2:
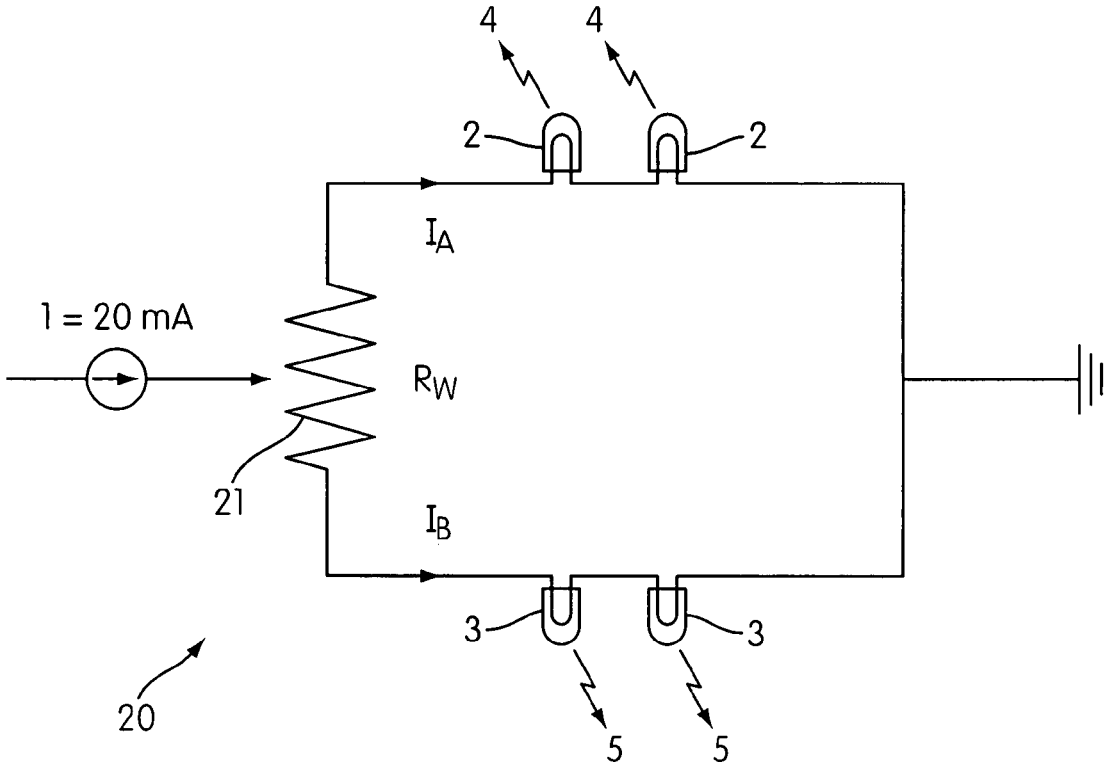
FIG. 2 is a driver circuit for operating the light source of FIG. 1.

Referring to FIG. 2 there is shown a schematic representation of a driver circuit 20 for operating the light source 1 of FIG. 1. The driver circuit 20 comprises a variable resistor 21 $R_w$ for controlling the relative drive currents $I_A$ and $I_B$ to the first and second LED arrangements 2, 3. The LEDs 9, 10 of each LED arrangement 2, 3 are connected in series and the LED arrangements connected in parallel to the variable resistor 21. The variable resistor 21 is configured as a potential divider and is used to select the relative drive currents $I_A$ and $I_B$ to achieve a selected correlated color temperature (CCT).

Figure 3:
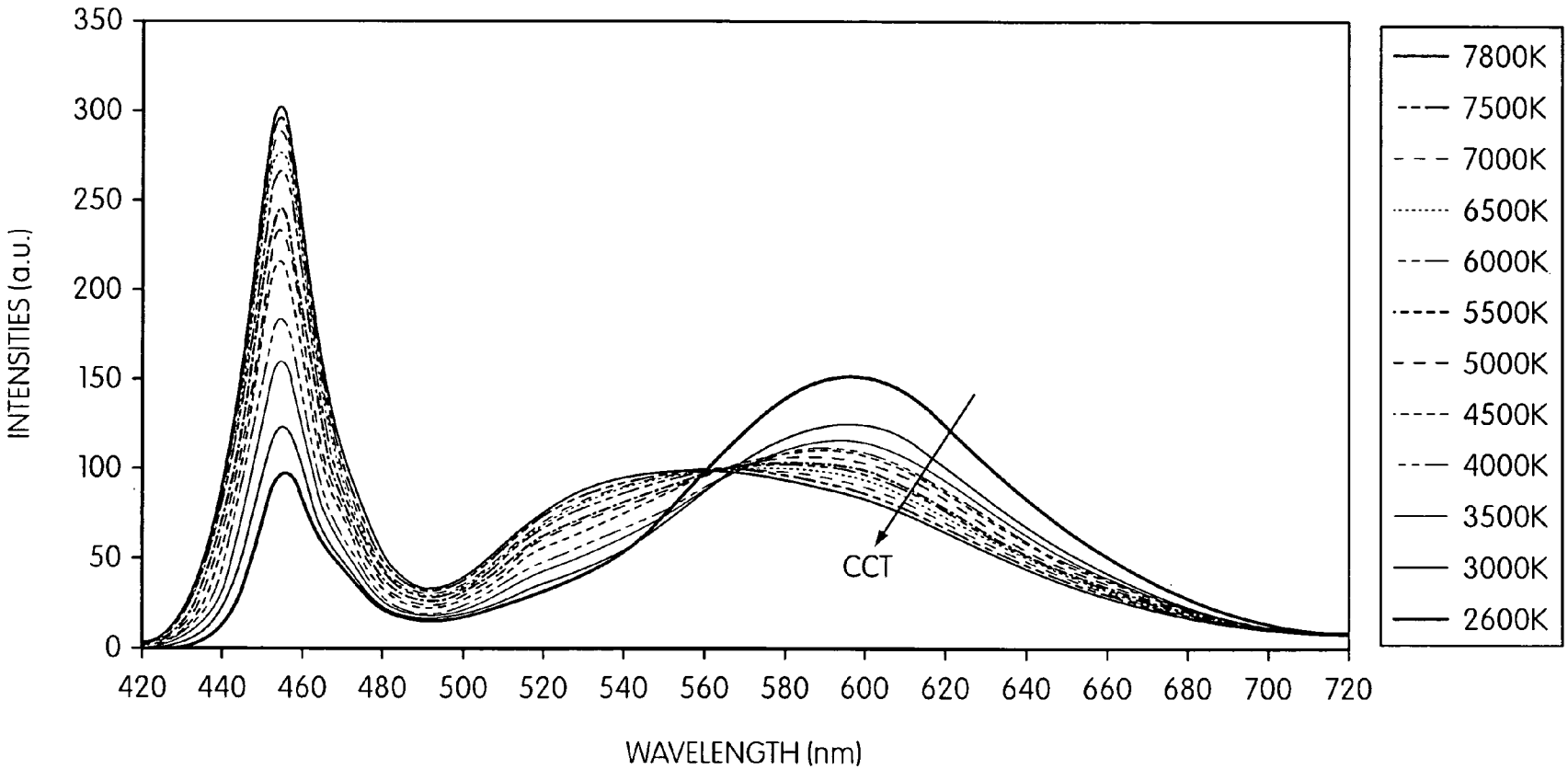
FIG. 3 is a plot of output light intensity versus wavelength for selected color temperatures for the source of FIG. 1.

FIG. 3 is a plot of output light intensity (arbitrary units) versus wavelength (nm) for the light source of FIG. 1 for selected CCTs 2600-7800K. The different color temperature white light is generated by changing the relative magnitude of the drive current $I_A$ and $I_B$. Table 1 tabulates chromaticity coordinates CIE (x, y) for selected ratios of drive currents $I_A/I_B$ and color temperatures CCT (K).

TABLE 1

Chromaticity coordinates CIE (x, y) for selected ratios of drive current $I_A/I_B$ and correlated color temperature CCT (K)

| CCT (K) | $I_A/I_B$ | CIE (x) | CIE (y) |
|---|---|---|---|
| 7800 | 8/92 | 0.300 | 0.305 |
| 7500 | 10/90 | 0.305 | 0.310 |
| 7000 | 14/86 | 0.310 | 0.313 |
| 6500 | 20/80 | 0.317 | 0.317 |
| 6000 | 27/73 | 0.324 | 0.321 |
| 5500 | 34/66 | 0.334 | 0.328 |
| 5000 | 40/60 | 0.342 | 0.333 |
| 4500 | 46/54 | 0.354 | 0.340 |
| 4000 | 55/45 | 0.369 | 0.350 |
| 3500 | 68/32 | 0.389 | 0.362 |
| 3000 | 83/17 | 0.418 | 0.380 |
| 2600 | 97/3 | 0.452 | 0.400 |

Figure 4:
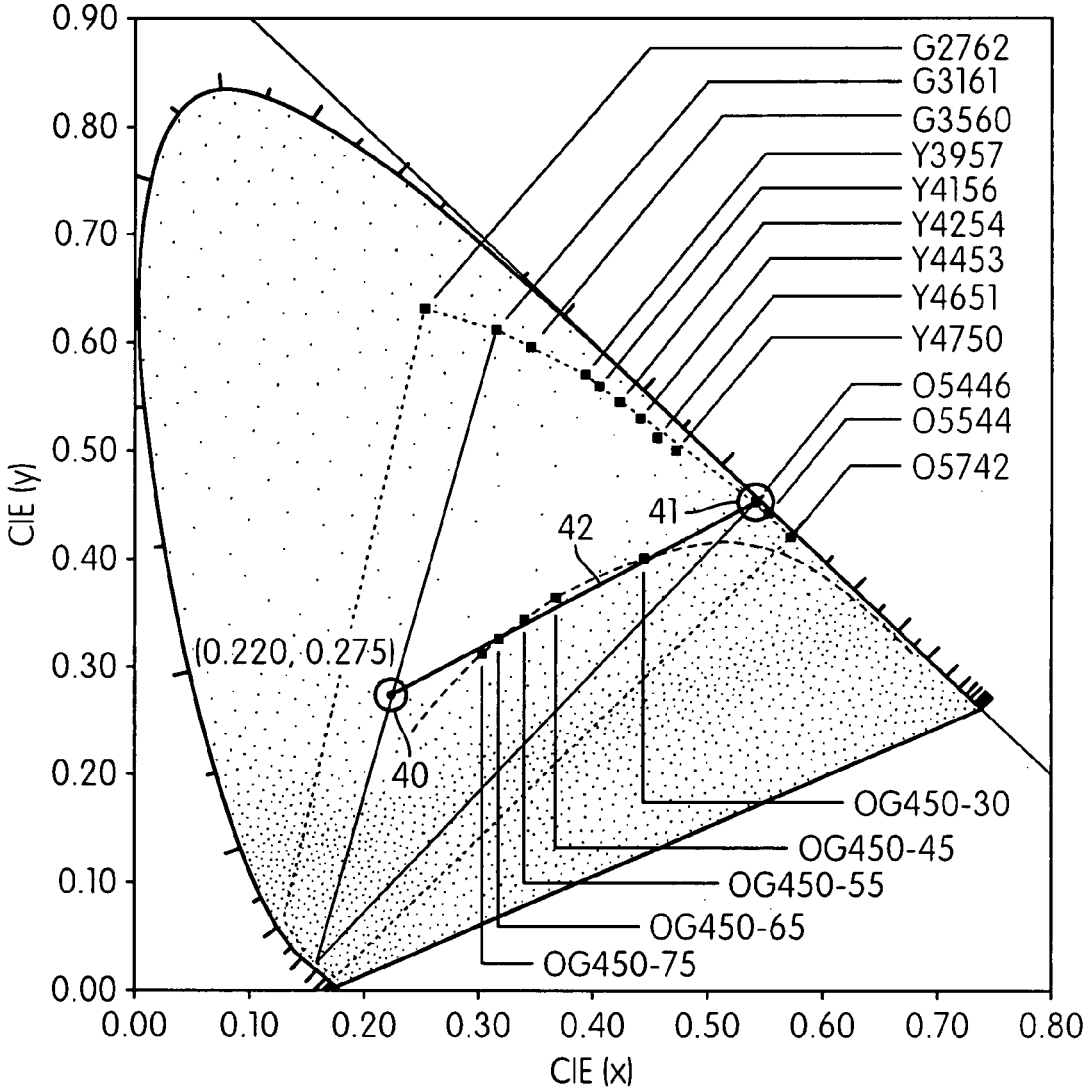
FIG. 4 is a Commission Internationale de l'Eclairage (CIE) xy chromaticity diagram indicating chromaticity coordinates for various phosphors.
Figure 5:
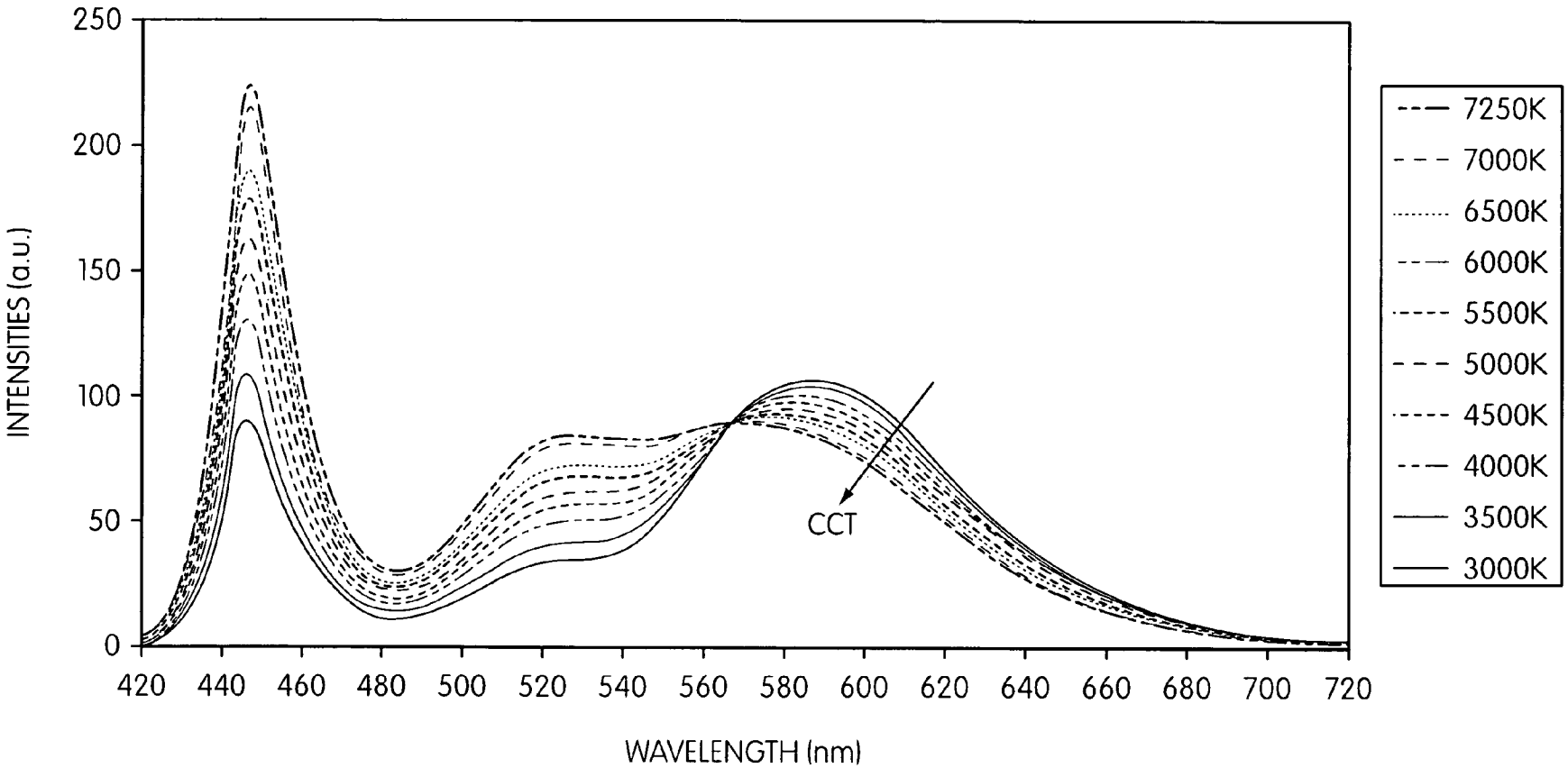
FIG. 5 is a plot of output light intensity versus wavelength for selected color temperatures.

In an alternative light source the first and second LED arrangements 2, 3 are operable to emit different colored light 4, 5 (that is other than white) which when combined together comprise light which appears to the eye to be white in color. In one such light source the first LED arrangement comprises an LED arrangement that emits blue-green light with chromaticity coordinates CIE (x, y) of (0.22, 0.275) and the second LED arrangement comprises an LED which emits orange light with chromaticity coordinates CIE (x, y) of (0.54, 0.46). Again the color temperature of the output white light is tuned by controlling the relative magnitudes of the drive currents to the LED arrangements. FIG. 4 is a Commission Internationale de l'Eclairage (CIE) 1931 xy chromaticity diagram for such a source indicating the chromaticity coordinates 40, 41 for the first and second LED arrangements respectively. A line 42 connecting the two points 40, 41 represents the possible color temperature of output light the source can generate by changing the magnitude of the drive currents $I_A$ and $I_B$. Also indicated in FIG. 4 are chromaticity coordinates for phosphors manufactured by Internatix Corporation of Fremont Calif., USA. FIG. 5 is a plot of output light intensity versus wavelength for selected color temperatures for a source in which the first LED emits blue-green light with chromaticity coordinates CIE (x, y) of (0.22, 0.275) and the second LED emits orange light with chromaticity coordinates CIE (x, y) of (0.54, 0.46). An advantage of using two different colored LED arrangements to generate white light is an improved performance, in particular a lower absorption, compared to using two white LED arrangements. Table 2 tabulates chromaticity coordinates CIE (x, y) for selected ratios of drive current on time $I_A/I_B$ and color temperatures CCT (K) for a source comprising orange and blue-green LEDs

TABLE 2

Chromaticity coordinates CIE (x, y) for selected ratios of drive current $I_A/I_B$ and color temperature CCT (K) where $I_A$ is the Orange and $I_B$ is the Blue-Green LED drive current.

| CCT (K) | $I_A/I_B$ | CIE (x) | CIE (y) |
|---|---|---|---|
| 8000 | 42/58 | 0.300 | 0.305 |
| 7500 | 45/55 | 0.305 | 0.310 |
| 7000 | 48/52 | 0.310 | 0.313 |
| 6500 | 51/49 | 0.317 | 0.317 |
| 6000 | 54/46 | 0.324 | 0.321 |
| 5500 | 58/42 | 0.334 | 0.328 |
| 5000 | 61/39 | 0.342 | 0.333 |
| 4500 | 66/34 | 0.354 | 0.340 |
| 4000 | 70/30 | 0.369 | 0.350 |
| 3500 | 77/23 | 0.389 | 0.362 |
| 3100 | 79/21 | 0.418 | 0.380 |

In another embodiment the first LED arrangement comprises a green-yellow phosphor 7 which is activated by a LED 9 which radiates blue light with a wavelength range from 440 nm to 470 nm and the second LED arrangement comprises an LED which emits red light with a wavelength range from 620 nm to 640 nm. In such an arrangement it will be appreciated that there is no need for the phosphor region 8.

Figure 6:
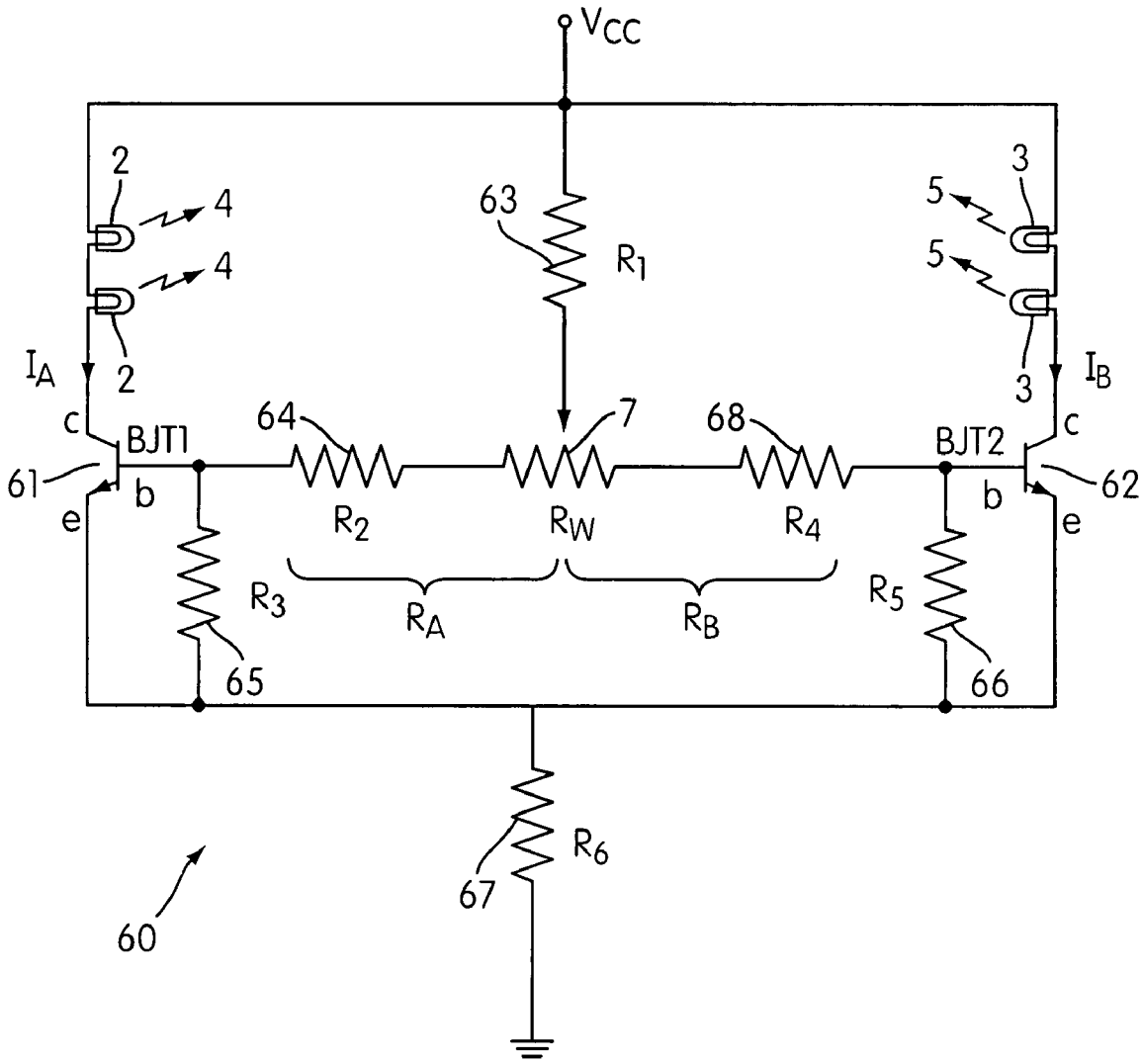
FIG. 6 is a further driver circuit for operating the light source of FIG. 1.

FIG. 6 shows a further driver circuit 60 for operating the light source of FIG. 1. The driver circuit 60 comprises a respective bipolar junction transistor BJT1, BJT2 (61, 62) for operating each LED arrangement 2, 3 and a bias network comprising reistors $R_1$ to $R_6$, denoted 63 to 68, respectfully, for setting the dc operating conditions of the transistors 61, 62. The transistors 61, 62 are configured as electronic switches in a grounded-emitter e configuration. The first and second LED arrangements are serially connected between a power supply $V_{CC}$ and the collector terminal c of their respective transistor. The variable resistor $R_W$ 7 is connected between the base terminals b of the transistors and is used to set the relative drive currents 1A and 1B (where $\mathbf{1}_A=\mathbf{1}_{ce}$ of BJT1 and $\mathbf{1}_B=\mathbf{1}_{ce}$ of BJT2) of the first and second LED arrangements 2, 3 and hence color temperature of the source by setting the relative voltage $V_{b1}$ and $V_{b2}$ at the base of the transistor. The control voltages $V_{b1}$ and $V_{b2}$ are given by the relationships:

$$V_{b1} = \left[\frac{R_A + R_1}{R_A + R_1 + R_3 + R_6}\right]V_{CC} \text{ and } V_{b2}\left[\frac{R_B + R_1}{R_B + R_1 + R_5 + R_6}\right]V_{CC}.$$

Figure 7:
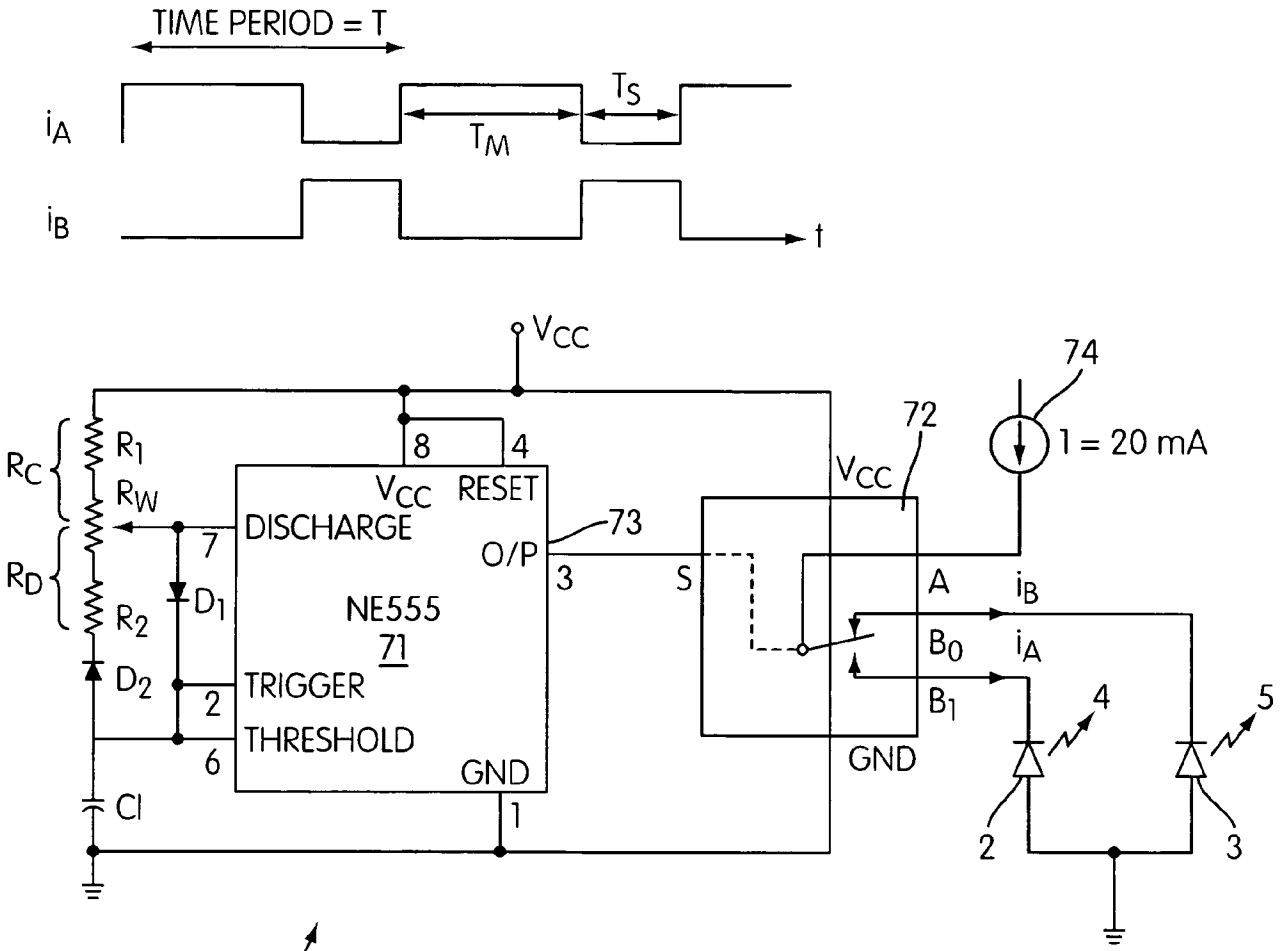
FIG. 7 a pulse width modulated driver circuit or operating the light source of FIG. 1.

As an alternative to driving the LED arrangements with a dc drive current $I_A$, $I_B$ and setting the relative magnitudes of the drive currents to set the color, the LED arrangements can be driven dynamically with a pulse width modulated (PWM) drive current $i_A$, $i_B$. FIG. 7 illustrates a PWM driver circuit 70 operable to drive the two LED arrangements 2, 3 on opposite phases of the PWM drive current (that is $i_B=\overline{i_A}$). The duty cycle of the PWM drive current is the proportion of a complete cycle (time period T) for which the output is high (mark time $T_m$) and determines how long within the time period the first LED arrangement is operable. Conversely, the proportion of time of a complete time period for which the output is low (space time $T_s$) determines the length of time the second LED arrangement is operable. An advantage of driving the LED arrangements dynamically is that each is operated at an optimum drive current though the time period needs to be selected to prevent flickering of the light output and to ensure light emitted by the two LED arrangements when viewed by an observer combine to give light which appears white in color.

The driver circuit 70 comprises a timer circuit 71, for example an NE555, configured in an astable (free-run) operation whose duty cycle is set by a potential divider arrangement comprising resistors $R_1$, $R_W$, $R_2$ and capacitor C1 and a low voltage single-pole/double throw (SPDT) analog switch 72, for example a Fairchild Semiconductor™ FSA3157. The output of the timer 73, which comprises a PWM drive voltage, is used to control operation of the SPDT analog switch 72. A current source 74 is connected to the pole A of the switch and the LED arrangements 2, 3 connected between a respective output $B_0$ $B_1$ of the switch and ground. In general the mark time $T_m$ is greater than the space time $T_s$ and consequently the duty cycle is less than 50% and is given by:

$$\text{Duty cycle (without signal diode } D_1) = \frac{T_m}{T_m + T_s} = \frac{R_C + R_D}{R_C + 2R_D}$$

where $T_m$=0.7 ($R_C$+$R_D$) C1, $T_s$=0.7 $R_C$ C1 and T=0.7 ($R_C$+2$R_D$) C.

To obtain a duty cycle of less than 50% a signal diode $D_1$ can be added in parallel with the resistance $R_D$ to bypass $R_D$ during a charging (mark) part of the timer cycle. In such a configuration the mark time depends only on $R_C$ and C1 ($T_m$=0.7 $R_C$ C1) such that the duty cycle is given:

$$\text{Duty cycle (with signal diode } D_1) = \frac{T_m}{T_m + T_s} = \frac{R_C}{R_C + R_D}.$$

Figure 8:
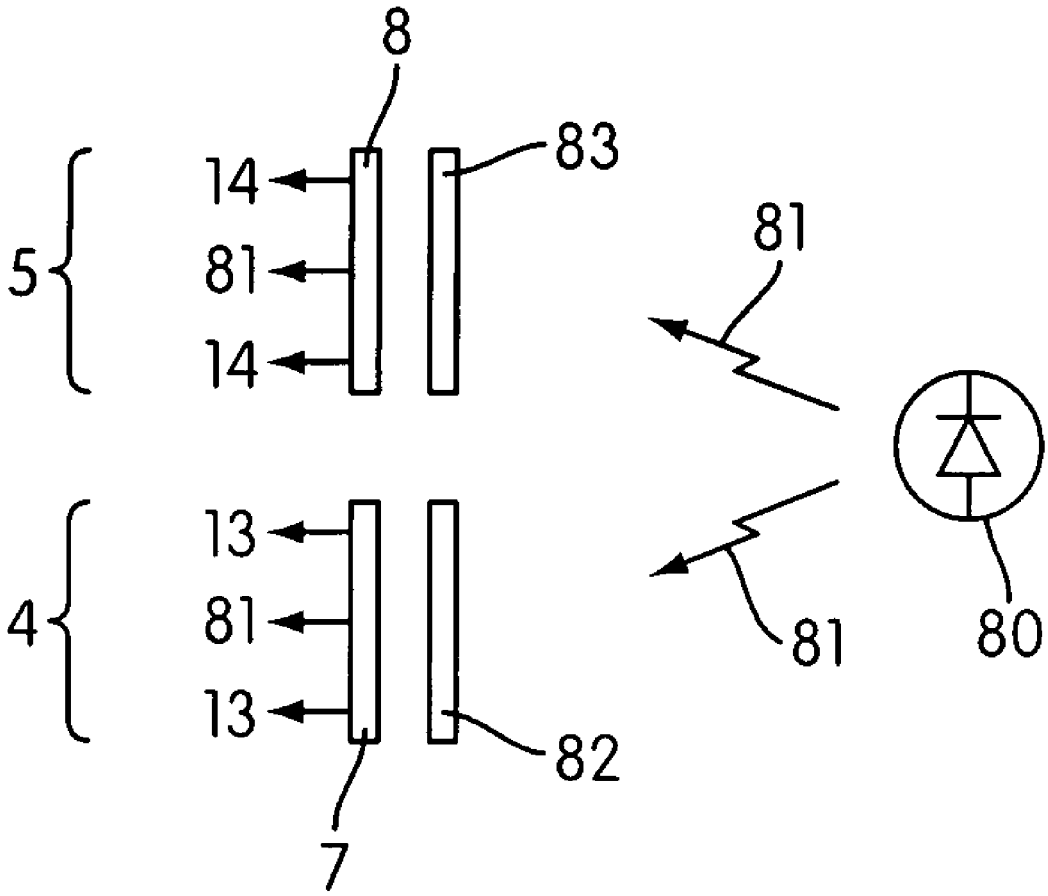
FIG. 8 a schematic representation of a further color temperature tunable white light source in accordance with the invention.

It will be appreciated by those skilled in the art that modifications can be made to the light source disclosed without departing from the scope of the invention. For example, whilst in exemplary implementations each LED arrangement is described as comprising a phosphor provided as a respective area remote to a respective LED die, in other embodiments, as shown in FIG. 8, it is envisaged to use one LED 80 to irradiate the two different phosphors 7, 8 with excitation energy 81. In such an arrangement the color temperature of the source cannot be controlled by controlling the drive current of the LED and a respective light controller 82, 83 is provided to control the relative light output from each LED arrangement. In one implementation the light controller 82, 83 comprises a respective LCD shutter and the LCD shutters can be controlled using the driver circuits described to control the drive voltage of the shutters. Moreover, the LCD shutters are advantageously fabricated as an array and the phosphor provided as a respective region on a surface of and overlaying a respective one of LCD shutter of the array.

The color temperature tunable white light sources of the invention find particular application in lighting arrangements for commercial and domestic lighting applications. Since the color temperature is tunable the white source of the invention is particularly advantageous when used in street lighting or vehicle headlights. As is known white light with a lower color temperature penetrates fog better than white light with a relatively warmer color temperature. In such applications a sensor is provided to detect for the presence of fog, moisture and/or measure its density and the color temperature tuned in response to optimize fog penetration.

What is claimed is:

1. A color temperature tunable white light source, the source comprising:

an array of first LED arrangements operable to emit white light with a color correlated temperature (CCT) in a range of 2500 K to 4000 K and second LED arrangements operable to emit white light with a color correlated temperature (CCT) in a range of 6000 K to 10,000 K;

wherein the LED arrangements are configured such that a composite light is emitted by the array;

wherein the relative drive currents of the first and second LED arrangements are controllable, and thus variable in relative magnitude, such that the color correlated temperature of the composite light emitted by the array is electrically tunable.

2. The color temperature tunable white light source of claim 1, wherein the at least one LED of the second LED arrangement is configured to excite a second remote phosphor.

3. The color temperature tunable white light source of claim 2, wherein the source is configured such that the relative excitations of the first and second phosphors are varied by controlling the relative magnitudes of the drive currents of the respective LED arrangements.

4. The color temperature tunable white light source of claim 1, wherein the source is configured such that relative magnitude of the drive currents is dynamically switched, and a duty cycle of the drive currents used to control the color temperature of the composite light emitted by the first and second LED arrangements.

5. The color temperature tunable white light source of claim 4, wherein the source is configured with a pulse width modulated current to drive the first and second LED arrangements, and wherein the source is further configured such that the first and second LED arrangements are driven on opposite phases of the pulse width modulated current.

6. The color temperature tunable white light source of claim 3, wherein the relative drive currents of the first and second LED arrangements are selected using a variable resistor configured as a potential divider.

7. The color temperature tunable white light source of claim 1, wherein the relative drive currents of the first and second LED arrangements are selected using a pair of bipolar junction transistors.

8. The color temperature tunable white light source of claim 5, wherein the drive circuit providing the pulse width modulated current to drive the first and second LED arrangements is a 555 timer/oscillator circuit configured in an astable (free-run) mode of operation.

9. The color temperature tunable white light source of claim 1, wherein the at least one LED of the first LED arrangement emits blue light in a wavelength ranging from 440 to 470 nm.

10. The color temperature tunable white light source of claim 1, wherein the at least one LED of the second LED arrangement is selected from the group consisting of an orange emitting LED and a red emitting LED.

11. A color temperature tunable white light source, the source comprising:

an array of first LED arrangements each comprising at least one LED configured to excite a remote phosphor, and to emit a cold white (CW) light having a color temperature ranging from about 6,000 K to 10,000 K, and second LED arrangements configured to emit a warm white (WW) light having a color temperature ranging from about 2,500 K to 4,000 K;

wherein the LED arrangements are configured such that a composite light is emitted by the array;

wherein the relative drive currents of the first and second LED arrangements are controlled via an electrical circuit to tune the composite light emitted by the array, the electrical circuit selected from the group consisting of a variable resistor potential divider, a pair of bipolar junction transistors, and a 555 timer/oscillator configured in an astable (free-run) mode of operation.

* * * * *